US005713613A

United States Patent [19]

Honma et al.

[11] Patent Number: 5,713,613

[45] Date of Patent: Feb. 3, 1998

[54] AUTOMOTIVE ELECTRIC DOOR LOCK SYSTEM

[75] Inventors: Mikio Honma; Kouichi Shigematsu; Junichi Shimada; Fumio Kobayashi, all of Yokohama, Japan

[73] Assignee: Ohi Seisakusho Co., Ltd., Yokohama, Japan

[21] Appl. No.: 647,264

[22] Filed: May 13, 1996

Related U.S. Application Data

[63] Continuation of Ser. No. 159,659, Nov. 30, 1993, abandoned.

[30] Foreign Application Priority Data

Nov. 30, 1992 [JP] Japan ..... 4-341026

[51] Int. Cl.[6] ..... E05C 13/10

[52] U.S. Cl. ..... 292/201; 292/216; 292/DIG. 23

[58] Field of Search ..... 200/61.62; 292/201, 292/216, DIG. 23, 336.3

[56] References Cited

U.S. PATENT DOCUMENTS

| | | | |
|---|---|---|---|
| 4,672,224 | 6/1987 | Low | 307/10 AT |
| 4,683,975 | 8/1987 | Booth et al. | 180/289 |
| 4,762,348 | 8/1988 | Matsumoto | 292/201 |
| 4,927,204 | 5/1990 | Asada | 292/216 |
| 4,932,277 | 6/1990 | Beaux | 74/89.15 |
| 4,968,074 | 11/1990 | Yamagishi et al. | 292/216 |
| 5,240,296 | 8/1993 | Kobayashi | 292/201 |
| 5,503,441 | 4/1996 | Schwaiger | 292/336.3 |

FOREIGN PATENT DOCUMENTS

| | | | |
|---|---|---|---|
| 3207880 | 9/1983 | Germany | 292/DIG. 23 |
| 60-148974 | 8/1985 | Japan . | |
| 4182587 | 6/1992 | Japan | 292/DIG. 23 |
| 5-78854 | 10/1993 | Japan . | |

*Primary Examiner*—Darnell M. Boucher
*Attorney, Agent, or Firm*—Foley & Lardner

[57] ABSTRACT

An automotive electric door lock system comprises a door lock which includes a latch plate latchedly engageable with a striker secured to the vehicle and a locking plate which is pivotable between an engaging position wherein the locking plate engages the latch plate and a releasing position wherein the locking plate releases the latch plate. An electric actuator is employed for moving the locking plate from the engaging position to the releasing position when energized. A power supply device energizes the electric actuator when a door handle is manipulated. A control device is used for instantly stopping the electric power supply to the electric actuator when the locking plate arrives at the releasing position.

9 Claims, 7 Drawing Sheets

AUTOMOTIVE ELECTRIC DOOR LOCK SYSTEM

This application is a continuation of application Ser. No. 08/159,659, filed Nov. 30, 1993, now abandoned.

BACKGROUND OF THE INVENTION

1. Field of the Invention

The present invention relates in general to automotive door lock systems, and more particularly to automotive electric door lock systems of a type which can electrically cancel the latched condition of the automotive door upon manipulation of a handle of the door.

2. Description of the Prior Art

In order to clarify the task of the present invention, one conventional automotive door lock system of the above-mentioned electric type will be briefly described, which is disclosed in Japanese Patent First Provisional Publication 60-148974.

The conventional electric lock system comprises generally a latch plate which can assume a latched condition catching a striker secured to the vehicle body, a locking plate which engages with the latch plate to selectively lock and unlock the latched condition of the latch plate, an electric actuator which can actuate the locking plate to cancel the latched condition of the latch plate, a door handle means which is manipulated when opening of the door is required, a door locking/unlocking switch which is manipulated when locking/unlocking of the closed door is required and a control means which can control operation of the door opening manipulation means in accordance with information signals issued from the door locking/unlocking switch. That is, when, with the door locking/unlocking switch issuing a signal representative of unlocked condition of the latch plate, the door handle means is manipulated, the control means energizes the electric actuator to cancel the latched condition of the latch plate.

However, the conventional electric lock system has the following drawback due to its inherent construction.

That is, for obtaining assured cancellation of the latched condition of the latch plate, the electric actuator is kept energized so long as the door handle means is kept manipulated. However, keeping the electric actuator energized for a long time tends to cause the same to seize.

SUMMARY OF THE INVENTION

It is therefore an object of the present invention to provide an automotive electric door lock system which is free of the above-mentioned drawback.

That is, according to the present invention, there is provided an automotive electric door lock system in which once a locking plate of a door lock comes to a releasing position due to manipulation of the door handle means, electric power supply to the electric actuator stops.

According to the present invention, there is provided an automotive electric door lock system comprising a door lock including a latch plate latchedly engageable with a striker secured to the vehicle and a locking plate pivotal between an engaging position wherein the locking plate engages the latch plate and a releasing position wherein the locking plate releases the latch plate; an electric actuator for moving the locking plate from the engaging position to the releasing position when energized; power means for energizing the electric actuator when a door handle is manipulated; and control means for instantly stopping the electric power supply to the electric actuator when the locking plate arrives at the releasing position.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, an embodiment of the present invention, which is an automotive electric door lock system, will be described in detail with reference to the accompanying drawings.

Figure 10:
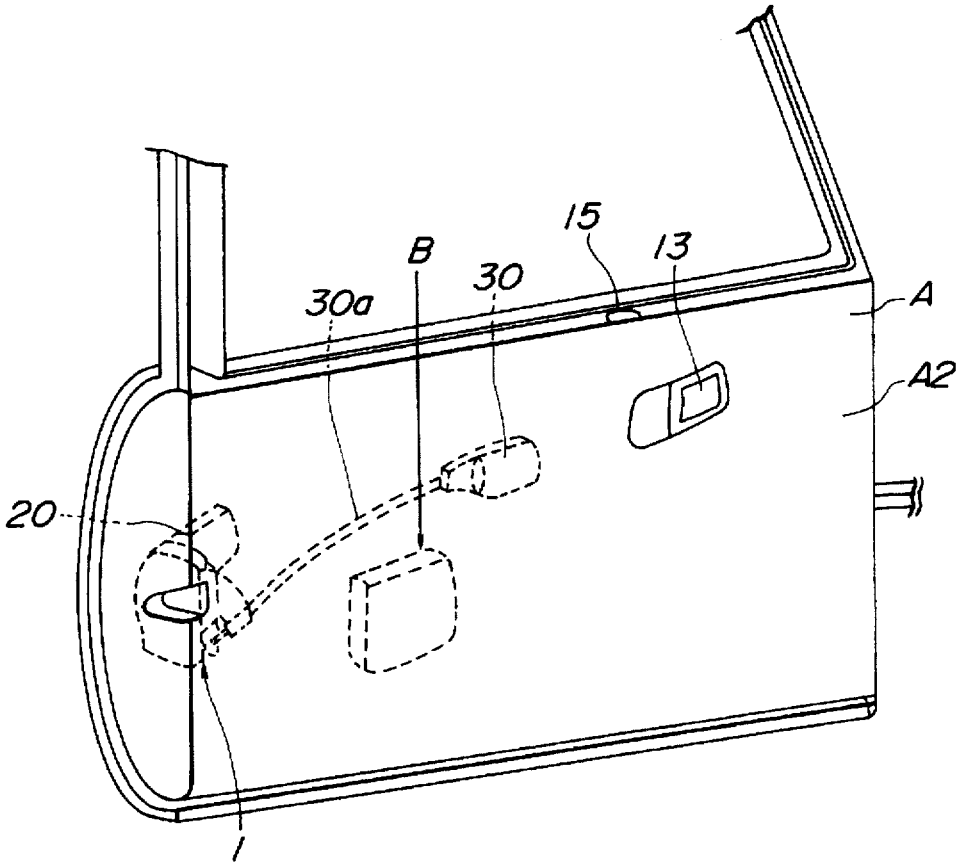
FIG. 10 is a view of the automotive door of FIG. 8, the view being taken from the inside of the vehicle.

Referring to FIG. 10, there is schematically shown the automotive door lock system of the present invention, which generally comprises a door lock 1 which is mounted to a hinged door "A" to detatchably engage with a striker **1*b* (see FIG. 5) secured to a vehicle body (not shown), an electric actuator 20 which, due to aid of a reversible electric motor, can cancel the engagement between the door lock i and the striker 1*b*, and an electric door closure 30** which, upon closing of the door "A" to a half-latch position, forces the door "A" to move to a full-latch position against a counter-force produced by a weather-strip of the door.

Figure 5:
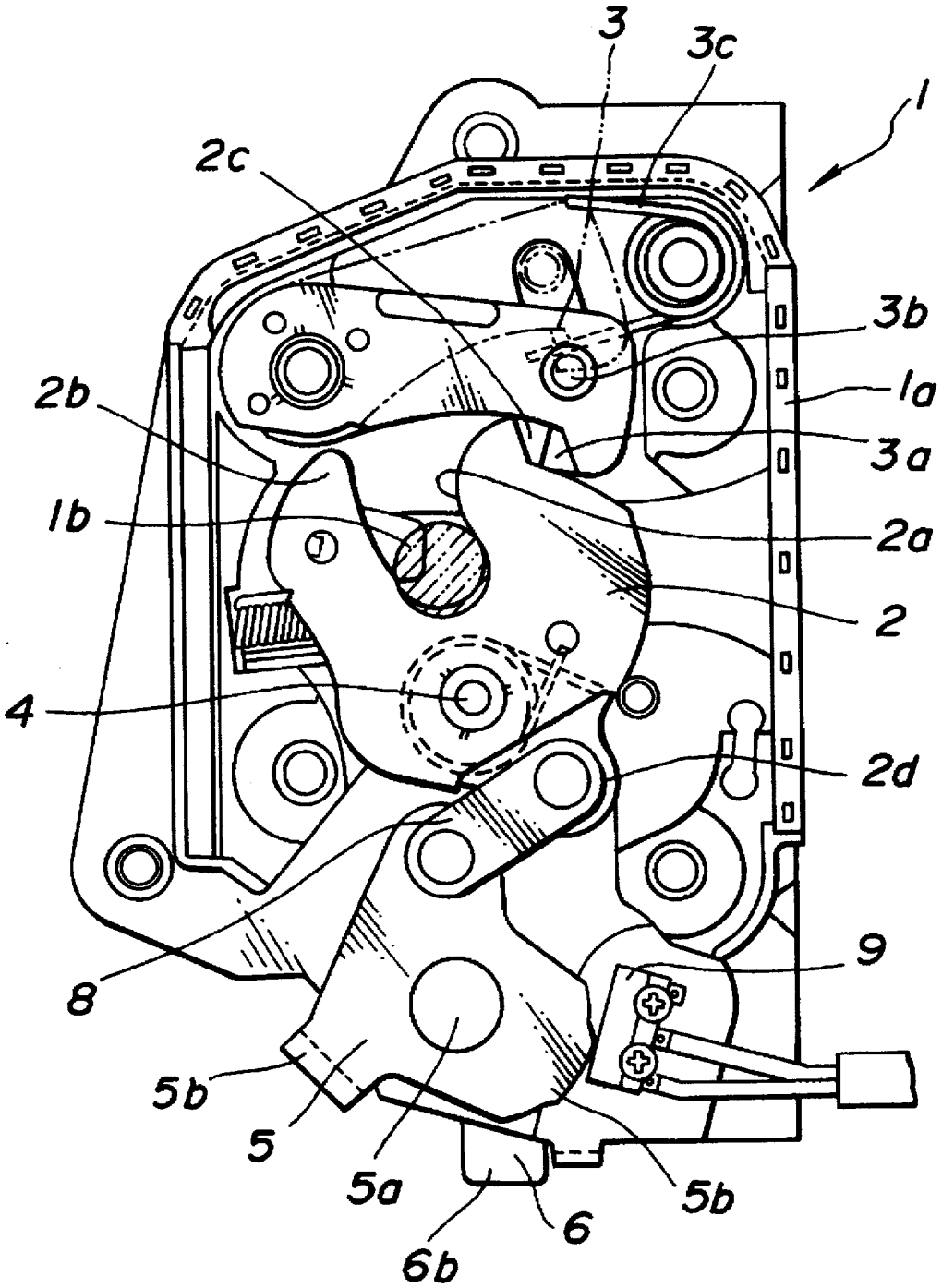
FIG. 5 is a front view of a door lock employed in the system of the invention, showing a full-latch condition of the door lock.

As is seen from FIG. 5, the door lock 1 comprises a body la which is secured to a free end of the hinged door (see FIG. 10), a latch plate 2 which is pivotally installed in the body **1*a* and latchedly engageable with the striker 1*b* secured to the vehicle body and a locking plate 3 which is detatchably engageable with the latch plate 2 and thus pivotal between an engaging position and a releasing position with respect to the latch plate 2. The latch plate 2 is formed with an engaging recess 2*a* for catching the striker 1*b*. That is, when the door "A" is almost closed, the striker 1*b* is inserted into the engaging recess 2*a* of the latch plate 2 turning the latch plate 2** to an after-mentioned full-latch position. Under this condition, the door "A" is fully latched at a full-closed position. While, when a door handle (not shown) is manipulated for opening the door "A", the latching condition of the latch plate 2 is canceled and thus the door "A" is permitted to open when pulled outward.

Figure 6:
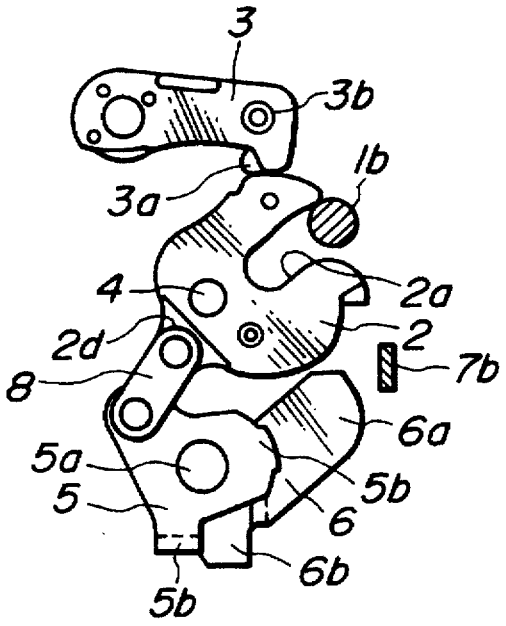
FIG. 6 is a view of essential parts of the door lock, showing a full-open condition of the door lock.
Figure 7:
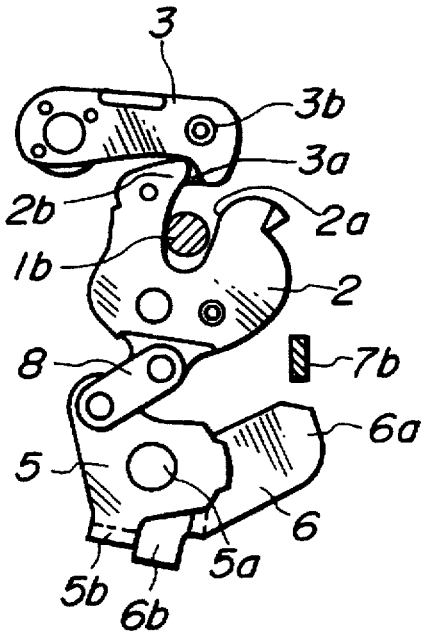
FIG. 7 is a view similar to FIG. 6, showing a half-latch condition of the door lock.

That is, the latch plate 2 has three major positions, which are a full-latch position as shown in FIG. 5 in which the engaging recess 2*a* of the latch plate 2 fully catches the striker 1*b* and a pawl portion 3*a* of the locking plate 3 engages an outside pawl 2*c* of the latch plate 2 suppressing a clockwise pivoting of the latch plate 2, a half-latch position as is shown in FIG. 7 in which the engaging recess 2*a* of the latch plate 2 incompletely catches the striker 1*b* and the pawl portion 3*a* of the locking plate 3 engaged an inside pawl 2*b* of the latch plate 2 suppressing a further clockwise pivoting of the latch plate 2, and a full-open position as shown in FIG. 6 in which the engaging recess 2*a* of the latch plate 2 completely releases the striker 1*b* and the pawl portion 3*a* of the locking plate 3 is substantially disengaged from both the outside and inside pawls 2*a* and 2*b* of the latch plate 2.

As is shown in FIG. 5, within the body 1*a*, there are disposed first and second closing levers 5 and 6 which can pivot around a shaft 5*a* independently. The first closing lever 5 is pivotally connected through a link 8 to a connecting portion 2*d* of the latch plate 2, so that the first closing lever 5 and the latch plate 2 make simultaneous pivoting movements.

Figure 11:
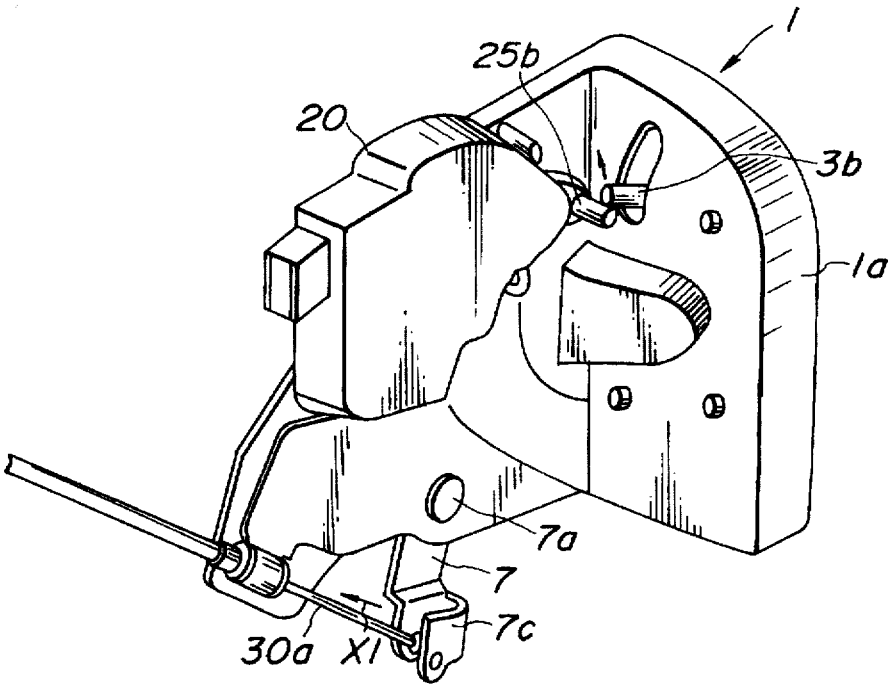
FIG. 11 is a perspective view of a door lock employed in the system of the invention.

As will be understood from FIGS. 7 and 11, the second closing lever 6 has a contact portion 6*a* which can abut against an end 7*b* of a third closing lever 7 in a certain condition.

As shown in FIG. 11, the third closing lever 7 is pivotally connected through a shaft 7*a* to a side wall of the body 1*a*. The third closing lever 7 has another end 7*c* from which a cable 30*a* extends to the electric door closure 30 (see FIG. 10). The door closure 30 includes an electric motor 30*b* (see FIG. 1) which produces power when electrically energized. The third closing lever 7 pivots between the illustrated inoperative position and an operative position which is assumed when moved in the direction of the arrow "XI".

Referring back to FIG. 5, denoted by numeral 9 is a half-latch detecting switch which can detect the half-latch condition of the latch plate 2. That is, when the latch plate 2 is within a range between the half-latch position and the full-latch position, a probe of the switch 9 is pressed by a cam portion 5*b* of the first closing lever 5 causing the switch 9 to go ON. Furthermore, when the latch plate 2 is pivoted from the full-open position to the half-latch position due to closing movement of the door, the switch 9 issues an information signal to the electric door closure 30 to energize the same thereby to force the latch plate 2 to pivot to the full-latch position.

The detail of the electric door closure 30 is shown in Japanese Utility Model First Provisional Publication 5-78854.

Figure 3:
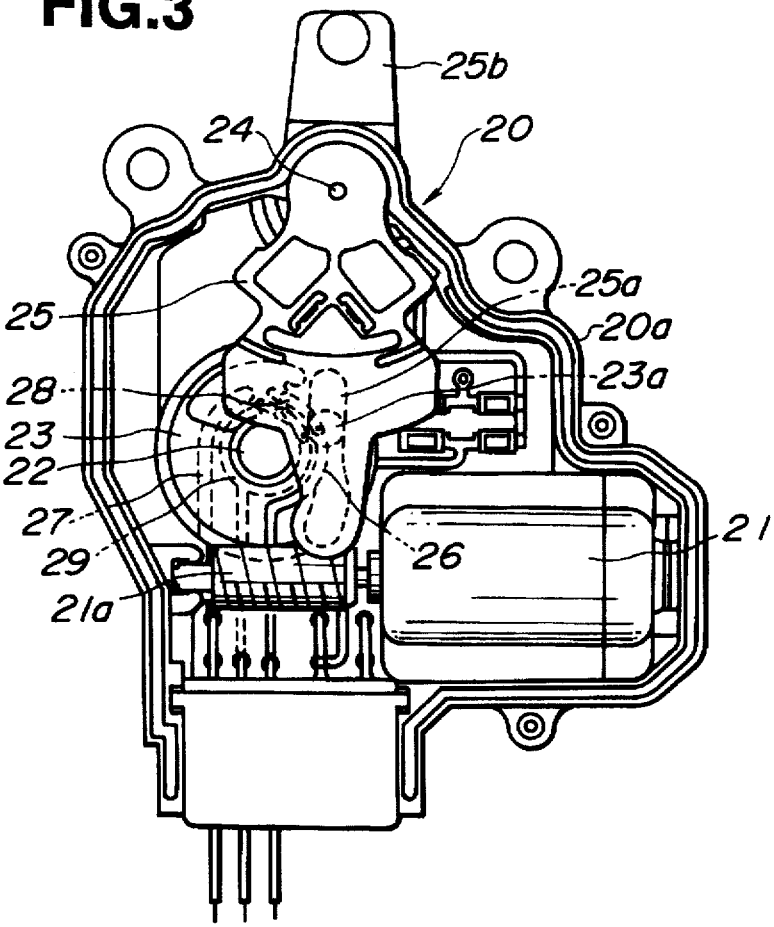
FIG. 3 is a front view of a drive unit employed in the automotive electric door lock system of the invention.

As is shown in FIG. 3, the electric actuator 20 comprises a case 20*a*, a reversible electric motor 21 installed in the case 20*a* and having a worm 21*a* mounted on an output shaft thereof, and a worm gear 23 meshed with the worm 21*a*. The worm 21*a* and the worm gear 23 thus constitute a speed reduction gear unit. An operation lever 25 is pivotally connected through a shaft 24 to the case 20 and pivots between a neutral position which is assumed when the locking plate 3 assumes the engaging position with respect to the latch plate 2 and an operative position which is assumed when the locking plate 3 assumes the releasing position. A neutral position detecting switch 26 and an operative position detecting switch 27 are disposed between the worm gear 23 and the case 2*a*. The switch 26 detects the neutral position of the operation lever 25, and the switch 27 detects the operative position of the operation lever 25.

Figure 4:
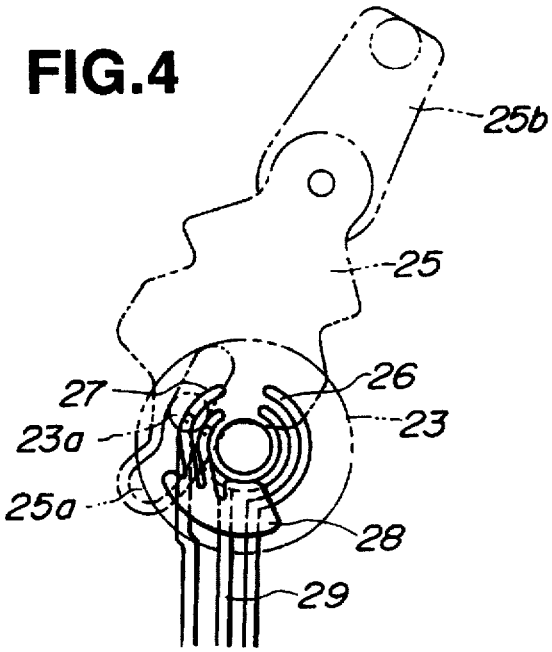
FIG. 4 is a view showing both a neutral position sensing switch and operative position sensing switch.

When the operation lever 25 is in the neutral position (which corresponds to the engaging position of the locking plate 3), a movable contact 28 secured to one surface of the lever 25 contacts an earth contact plate 29 secured to the case 20*a*, which causes an ON condition of the neutral position detecting switch 26. Thus, the neutral position of the operation lever 25 is detected. When the operation lever 25 pivots to the operative position (which corresponds to the releasing position of the locking plate 3) as shown in FIG. 4, the movable contact 28 is brought into contact with the earth contact plate 29 and causes the ON condition of the operative position detecting switch 27. Thus, the operative position of the operation lever 25 is detected.

The operation lever 25 is formed at the other surface with an engaging groove 25*a* which engages with a projection 23*a* formed on the worm gear 23. When the worm gear 23 is turned in one direction, that is, clockwise in FIG. 3 or in the other direction, that is, counterclockwise, the projection 23*a* slides in the engaging groove 25*a* causing the operation lever 25 to pivot between the neutral and operative positions. Designated by numeral 25*b* is a cancel lever which projects from the case 20*a* and moves together with the operation lever 25 as a unit. Thus, the cancel lever 25*b* has neutral and operative positions which correspond to those of the operation lever 25.

When the cancel lever 25*b* is pivoted to the operative position of FIG. 4, the same is brought into abutment with a projection 3*b* (see FIG. 5) of the locking plate 3 thereby to pivot the locking plate 3 to the releasing position as shown by a phantom line in FIG. 5. With this, the pawl portion 3*a* of the locking plate 3 is disengaged from the latch plate 2, and thus the latched engagement between the latch plate 2 and the striker 1*b* becomes canceled. Thus, if an external force is applied to the door "A", the door is permitted to open.

Figure 8:
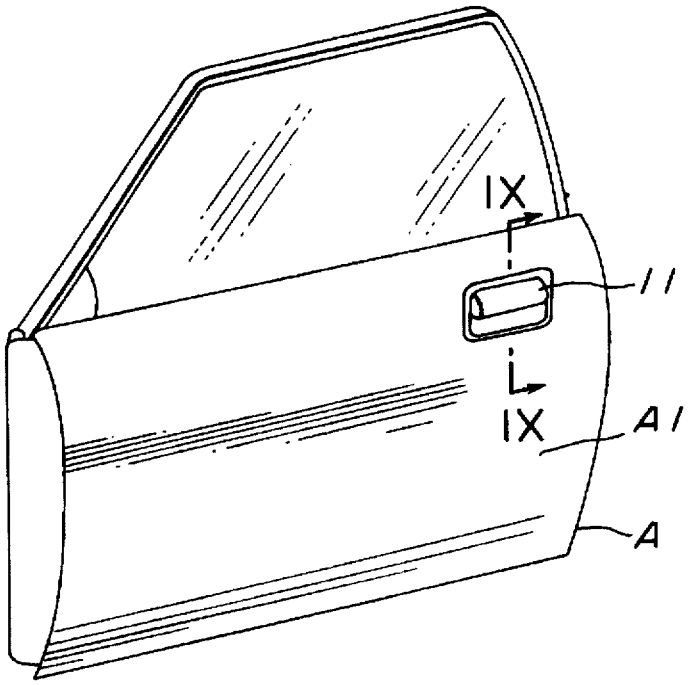
FIG. 8 is a view of an automotive door to which the door lock system of the invention is applied, the view being taken from the outside of an associated vehicle.
Figure 9:
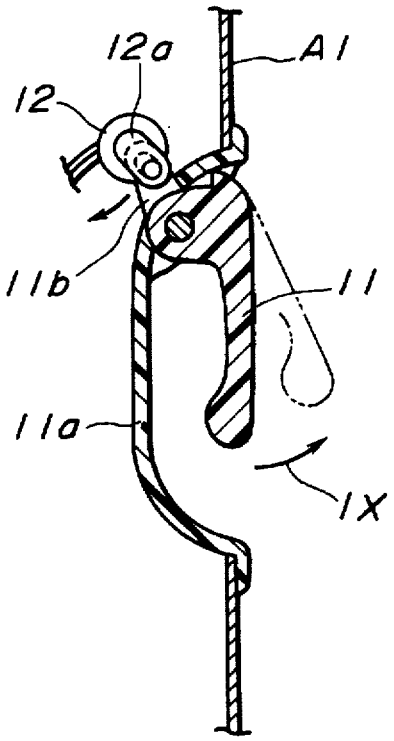
FIG. 9 is an enlarged sectional view taken along the line IX—IX of FIG. 8.

Referring to FIGS. 8 and 9, there is shown the door "A" to which the present invention is applied. In these drawings, denoted by numeral 11 is an outside handle which is operatively connected to an outer panel A1 of the door "A". The outside handle constitutes a part of a door opening manipulation means. As shown in FIG. 9, the outside handle 11 is pivotally installed in an escutcheon 11*a* mounted on the outer panel A1. An inside end 11*b*of the handle 11 is connected to a detection lever 12*a* of an outside handle switch 12. That is, the switch 12 can detect movement of the outside handle 11 in the direction of the arrow "IX" made by a passenger for opening the door "A".

Referring to FIG. 10, denoted by numeral 13 is an inside handle which is pivotally connected to an inner panel A2 of the door "A". An inside handle switch 14 is connected to the inside handle 13 for detecting operation of the handle 13.

Designated by numeral 15 is a locking/unlocking operation switch unit which, when a button of the unit is pushed downward, locks the latch plate 2 at the full-latch position and, when pushed upward, cancels the locked condition of the latch plate 2. That is, when the button of the switch unit 15 is pushed downward, a locking switch 15*a* (see FIG. 1) is turned ON and a corresponding information signal is fed to an input port of a control device (viz., CPC) 40. When the button of the switch unit 15 is pushed upward, an unlocking switch 15*b* is turned ON and a corresponding information signal is fed to the input port of the control device 40. If desired, light emitting diodes (LED) may be employed, which are arranged to emit different color lights when the button is pushed downward and upward.

Figure 1:
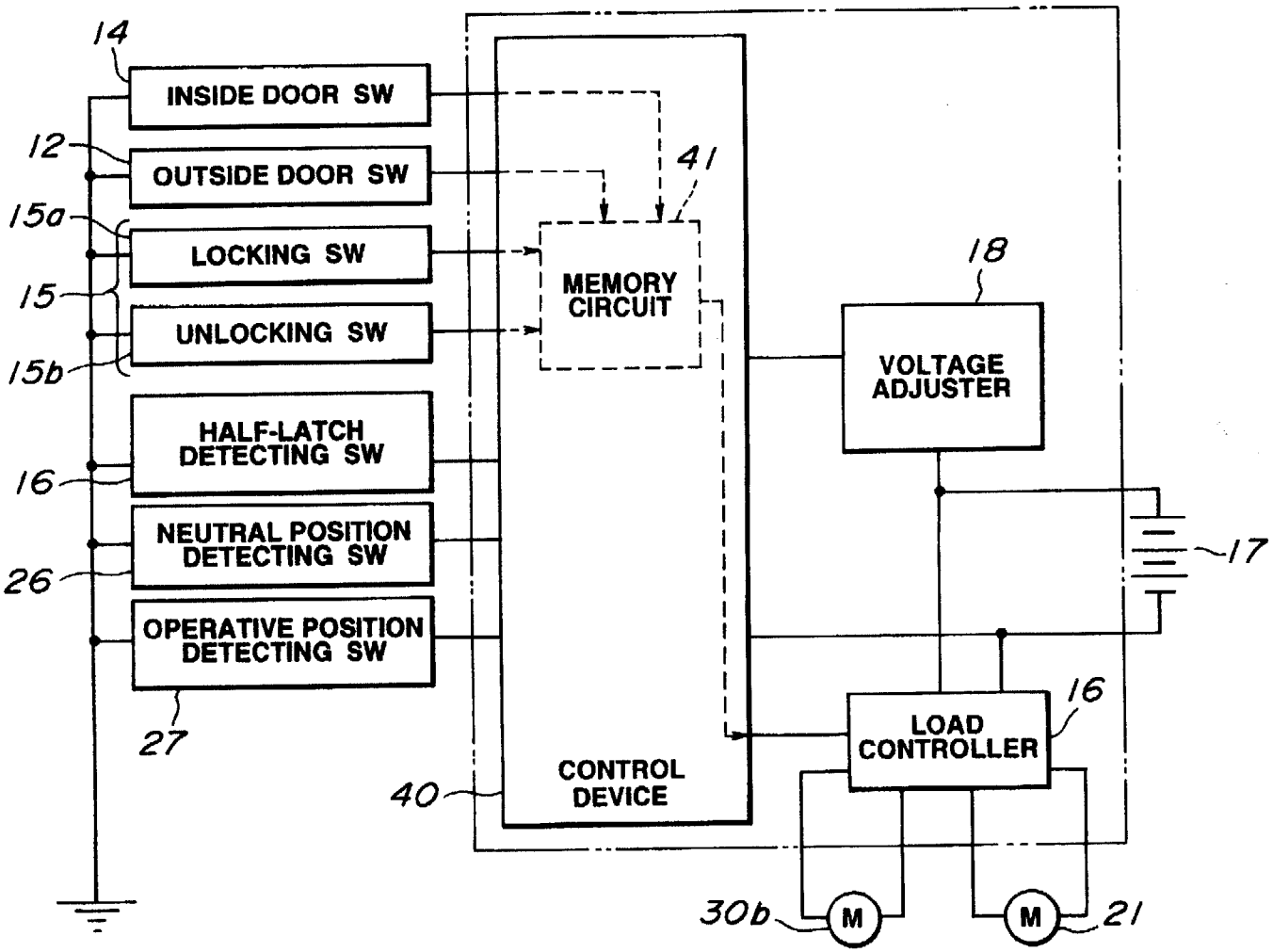
FIG. 1 is a block diagram of a control device employed in an automotive electric door lock system according to the present invention.

Referring to FIG. 1, there is shown a control circuit for the door lock system of the invention, which comprises a microcomputer having a locking/unlocking condition memory circuit 41. Designated by numeral 17 is a battery, and designated by numeral 18 is a voltage adjuster which adjusts the voltage applied to the microcomputer.

When the locking switch 15*a* of the switch unit 15 is turned ON, the memory circuit 41 memorizes the turn-ON operation of the switch 15*a* (viz., the locked condition of the latch plate 2 at the full-latch position). When, with the latch plate 2 being locked at the full-latch position, the unlocking switch 15*b* is turned ON, the memory circuit 41 updates the data and memorizes the turn-ON operation of the other switch 15*b* (viz., unlocked condition of the latch plate 2 at the full-latch position).

When, with the memory circuit 41 memorizing the unlocked condition of the latch plate 2, the outside handle 11 or the inside handle 14 is manipulated to such an extent as to turn the outside handle switch 12 or the inside handle switch 14 ON, the computer 40 outputs a high level output signal to a load controller 16 to energize the same. With this, the electric motor 21 of the electric actuator 20 is energized to turn in the direction to turn the worm gear 23 in the direction to cause the locking plate 3 (see FIG. 5) to assume the releasing position. Thus, under this condition, the door "A" is permitted to open.

More specifically, when the motor 21 of the electric actuator 20 is fed with an electric power to turn in one direction, the cancel lever 25*b* and the operation lever 25 are pivoted from their neutral positions to their operative positions as shown in FIG. 4. During this, the cancel lever 25*b* moves the locking plate 3 from the engaging position to the releasing position against a biasing force of a spring 3*c*. During movement of the operation lever 25 to the operative position together with the cancel lever 25*b*, the movable contact 28 (see FIGS. 3 and 4) is moved while contacting with the earth contact plate 29 and separated from the neutral position detecting switch 26 and finally brought into contact with the operative position detecting switch 27. Thus, the switch 26 is turned OFF and the other switch 27 is turned ON detecting the cancel lever 25*b* placed at the operative position. Upon this, the power supply to the motor 21 of the electric actuator 20 stops. Thus, thereafter, the cancel lever 25*b* is kept at the operative position and thus the locking plate 3 is kept at the releasing position. Under this condition, the door "A" is permitted to open when pulled from the outside or pushed from the inside of the vehicle.

When thereafter the door "A" starts the opening movement, the latch plate 2 is pivoted from the full-latch position to the full-open position releasing the striker 1*b*. Thus, the half-latch detecting switch 9 is turned ON. With this, the motor 21 of the electric actuator 20 is energized to turn in the other direction. Thus, the cancel lever 25*b* and the operation lever 25 are pivoted from their operative positions of FIG. 4 to their neutral positions of FIG. 3. When the operation lever 25 thus comes to the neutral position, the neutral position detecting switch 26 is turned ON, which stops power supply to the motor 21. Thus, thereafter, the operation lever 25 and the cancel lever 25*b* are kept at their neutral positions.

When the memory circuit 41 memorizes the locked condition of the latch plate 2 at the full-latch position, manipulation of the outside handle 11 or the inside handle 14 to such an extent as to turn the switch 12 or the switch 14 ON does not induce power to be supplied to the motor 21 of the actuator 20. That is, under the locked condition of the latch plate 2, manipulation of the handle 11 or 14 has no effect on the locked door "A".

Figure 2:
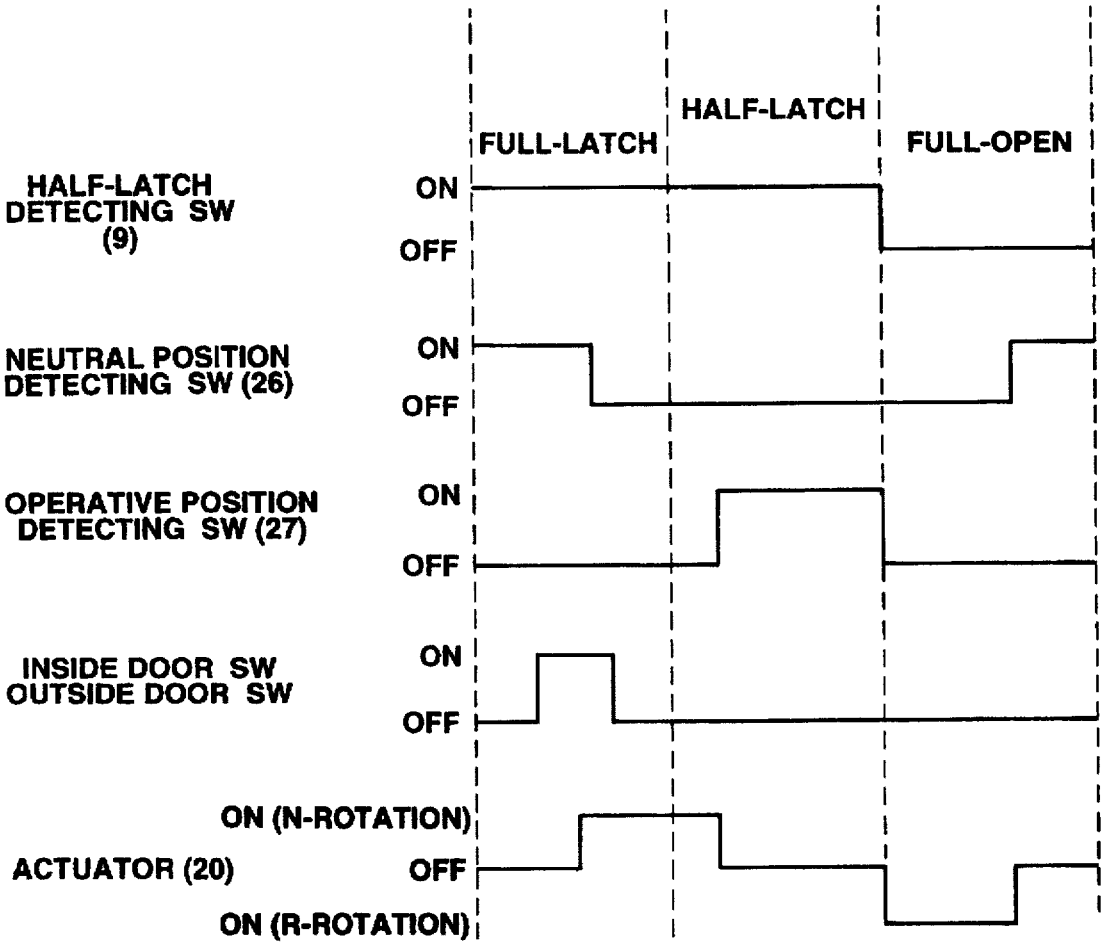
FIG. 2 is a time chart showing ON and OFF conditions of various elements of the control device with respect to the elapsed time.

In the following, operation of the electric door lock system of the invention will be described with reference to the time chart of FIG. 2.

For ease of understanding, the description will be commenced with respect to a fully-closed condition of the door "A".

Under this condition, the latch plate 2 takes the full-latch position as shown in FIG. 5. At this position, the half-latch detecting switch 9 is in ON condition, and the cancel lever 25*b* assumes the neutral position as shown in FIG. 3 causing an ON condition of the neutral position detecting switch 26 and an OFF condition of the operative position detecting switch 27.

When, with the memory circuit 41 memorizing the unlocked condition of the latch plate 2, the outside handle 11 or the inside handle 14 is manipulated to such an extent as to turn the switch 12 or the switch 14 ON, the motor 21 of the electric actuator 20 is energized to turn in a normal direction. As is seen from the time chart of FIG. 2, energization of the motor 21 takes place a given time "t" after the ON manipulation of the switch 12 or 14. The cancel lever 25*b* is thus pivoted to the operative position of FIG. 4. Due to the movement of the cancel lever 25*b* to the operative position, the movable contact 28 is separated from the neutral position detecting switch 26 causing the switch 26 to turn OFF and thereafter causing the operative position detecting switch 27 to turn ON. Receiving OFF and ON signals from these switches 26 and 27, the computer judges that the cancel lever 25*b* has just come to the operative position of FIG. 4. Because of the movement of the cancel lever 25*b* from the neutral position, the locking plate 3 (see FIG. 5) is pivoted to the releasing position against the force of the spring 3*c*. Thus, the latched engagement between the latch plate 2 and the striker 1*b* becomes canceled.

When the computer judges the arrival of the cancel lever 25*b* at the operative position of FIG. 4, the computer stops power supply to the motor 21 of the electric actuator 20. Thus, the cancel lever 25*b* stops at the operative position keeping the locking plate 3 at the releasing position.

It is now to be noted that, under this condition, the motor 21 of the electric actuator 20 is not energized. This means that even when the door handle means (viz., outside handle or inside handle) is kept manipulated for a long time, the motor 21 does not seize unlike the afore-mentioned conventional system.

When the door "A" is pulled outward, the striker 1*b* is disengaged from the engaging recess 2*a* of the latch plate 2 turning the latch plate 2 to the full-open position of FIG. 6. With this turning of the latch plate 2, the half-latch detecting switch 9 is turned OFF sensing the movement of the latch plate 2 toward the full-open position, so that the computer operates the motor 21 of the electric actuator 20 to run in a reversed direction. With this, the cancel lever 25*b* is pivoted back to the neutral position and thus the locking plate 3 is pivoted to the engaging position as is seen from FIG. 6. When the cancel lever 25*b* is pivoted to the neutral position, the movable contact 28 is brought into contact with the neutral position detecting switch 26. Thus, the switch 26 can sense the operation lever 25 placed at the neutral position, which stops power supply to the motor 21 of the actuator 20. Thus, while the door "A" is kept open, the cancel lever 25*b* and the operation lever 25 assume their neutral positions as shown in FIG. 3 and the latch plate 2 assumes the full-open position as shown in FIG. 6.

In the following, operation carried out when the door "A" is pivoted from the open position to the closed position will be described.

When the door "A" is strongly pushed from the outside of the vehicle, the striker 1*b* (see FIG. 6) is rushed into the engaging recess 2*a* of the latch plate 2 causing the latch plate 2 to instantly pivot from the full-open position of FIG. 6 to the full-latch position of FIG. 5. During this, the half-latch detecting switch 9 is turned ON.

While, when the door "A" is softly pushed and thus the door "A" stops at the half-latch position as shown in FIG. 7, the electric door closure 30 works to move the door "A" from the half-latch position to the full-latch position, as is described in the afore-mentioned Japanese Utility Model First Provisional Publication 5-78854.

What is claimed is:

1. An automotive electric door lock system comprising:

a door lock including a latch plate latchedly engageable with a striker secured to a vehicle and a locking plate pivotable between an engaging position, where the locking plate engages said latch plate, and a releasing position, where the locking plate releases said latch plate;

an electric actuator which moves said locking plate from said engaging position to said releasing position when energized;

power means for energizing said electric actuator when a door handle is manipulated;

a neutral position detecting switch which issues a first signal when said locking plate assumes said engaging position;

an operative position detecting switch which issues a second signal when said locking plate assumes said releasing position;

a half-latch position detecting switch which issues a third signal when said latch plate is at least half-latched to said striker; and a control device which controls said power means to deenergize said electric actuator when receiving said first signal and said second signal in consecutive order to thereby keep said locking plate at said releasing position as long as said third signal is issued to indicate that said latch plate is at least half-latched to said striker.

2. An automotive electric door lock system as claimed in claim 1, in which said first signal is issued when said neutral position detecting switch is turned from an OFF condition to an ON condition and in which said second signal is issued when said operative position detecting switch is turned from an OFF condition to an ON condition.

3. An automotive electric door lock system as claimed in claim 2, in which said control device controls, said power means to energize the electric actuator to run in a reversed direction when said half-latch detecting switch no longer issues said third signal under a condition where said neutral position detecting switch and said operative position detecting switch keep OFF and ON conditions respectively.

4. An automotive electric door lock system as claimed in claim 3, in which said control device controls said power means to stop the power supply to said electric actuator when receiving an OFF signal from said operative position detecting switch followed by an ON signal from said neutral position detecting switch.

5. An automotive electric door lock system as claimed in claim 4, in which said electric actuator includes:

a reversible electric motor;

a worm mounted to an output shaft of said motor;

a worm gear meshed with said worm, said worm gear having a projection;

a pivotable operation lever whose position is directly detected by said neutral and operative position detecting switches, said operation lever being formed with an engaging groove to which said projection of said worm gear engages so that rotation of said worm gear in one and other directions induces pivoting movement of said operation lever; and a cancel lever connected to said operation lever to move therewith, said cancel lever having a portion engaged with a projection formed on the locking plate of said door lock.

6. An automotive door lock system comprising:

a door lock having a latch mechanism which includes a latch plate engageable with a striker and a locking plate engageable With said latch plate and movable between an engaging position and a releasing position;

an electric drive means operably connected to said locking plate, said electric drive means being capable of canceling a latching operation of said latch mechanism upon receiving a cancel signal representative of manipulation of a door handle;

a neutral position detecting switch associated with said electric drive means, said switch being capable of detecting a neutral position which corresponds to said engaging position of said locking plate;

an operative position detecting switch associated with said electric drive means, said operative position detecting switch being capable of detecting an operative position which corresponds to said releasing position of said locking plate; and a control device for controlling said electric drive means in such a manner that under a door closed condition, when said neutral position detecting switch detects said neutral position and said door handle is manipulated, said electric drive means is energized to cancel the latching operation of said latch mechanism until said operative position detecting switch detects said operative position, at which time, said electric drive means is deenergized and said locking plate is maintained at said releasing position as long as the door is not opened to a door open condition, and subsequently, when the door is opened to the door open condition and said latch plate is no longer engaged with said striker, said electric drive means is energized to rotate in a reversed direction until said neutral position detecting switch detects said neutral position, at which time, said electric drive means is deenergized.

7. An automotive electric door lock system comprising:

a door lock including a latch plate latchedly engageable with a striker secured to a vehicle and a locking plate pivotable between an engaging position, where the locking plate engages said latch plate, and a releasing position, where the locking plate releases said latch plate;

an electric actuator for moving said locking plate from said engaging position to said releasing position when energized;

power means for energizing said electric actuator when a door handle is manipulated;

a neutral position detecting switch which issues a first signal when said locking plate assumes said engaging position;

an operative position detecting switch which issues a second signal when said locking plate assumes said releasing position;

a half-latch position detecting switch which issues a third signal when said latch plate is at least partially latched to said striker; and a control device which controls said power means to deenergize said electric actuator when receiving said first signal and said second signal in consecutive order to thereby keep said locking plate at said releasing position so long as said third signal is issued.

8. An automotive electric door lock system as claimed in claim 7, wherein said latch plate has three positions including fully-latched, half-latched, and unlatched, and wherein said half-latch position detecting switch issues the third signal when said latch plate is fully-latched or half-latched, but not when said latch plate is unlatched.

9. An automotive electric door lock system as claimed in claim 8, wherein said control device controls said power means to energize said electric actuator to rotate in an opposite direction to return said locking plate to said engaging position when said third signal is no longer issued after said control device receives said first signal and said second signal in consecutive order.

* * * * *